US008607488B2

(12) United States Patent
Johnston

(10) Patent No.: US 8,607,488 B2
(45) Date of Patent: Dec. 17, 2013

(54) BOLLARD ADVERTISING SYSTEMS AND METHODS

(75) Inventor: Brandon Steele Johnston, Longview, TX (US)

(73) Assignee: Screen Trans Development Corp., Moonachie, NJ (US)

( * ) Notice: Subject to any disclaimer, the term of this patent is extended or adjusted under 35 U.S.C. 154(b) by 0 days.

(21) Appl. No.: 13/155,206

(22) Filed: Jun. 7, 2011

(65) Prior Publication Data

US 2012/0090207 A1 Apr. 19, 2012

Related U.S. Application Data

(60) Provisional application No. 61/352,222, filed on Jun. 7, 2010.

(51) Int. Cl.

| | |
|---|---|
| ***G09F 7/00*** | (2006.01) |
| ***G09F 15/02*** | (2006.01) |
| ***G09F 17/00*** | (2006.01) |
| ***G09F 15/00*** | (2006.01) |

(52) U.S. Cl.
USPC ..... 40/612; 40/607.01; 40/306; 40/604; 40/607.03; 40/608; 404/6; 404/9; 256/1; 256/13.1

(58) Field of Classification Search
USPC ..... 40/612, 607.01, 306, 604, 607.03, 608; 404/6, 9; 256/1, 13.1
See application file for complete search history.

(56) References Cited

U.S. PATENT DOCUMENTS

| | | | | |
|---|---|---|---|---|
| 4,635,996 | A | 1/1987 | Hirose | |
| 4,742,630 | A | 5/1988 | Scumaci | |
| 4,765,381 | A * | 8/1988 | Castle | 383/20 |
| 5,299,883 | A | 4/1994 | Arth, Jr. | |
| 5,487,618 | A | 1/1996 | Cox | |
| 5,500,642 | A * | 3/1996 | Battle | 340/932.2 |
| 5,860,237 | A * | 1/1999 | Johnson | 40/603 |
| 6,101,751 | A | 8/2000 | Hicks | |
| 6,129,802 | A * | 10/2000 | Key | 156/229 |
| 6,233,858 | B1 | 5/2001 | Brach, Jr. et al. | |
| 6,341,713 | B1 * | 1/2002 | Kilmer | 220/694 |
| 7,257,875 | B2 * | 8/2007 | Masinelli et al. | 29/449 |
| 2005/0166430 | A1 * | 8/2005 | Zarelius | 40/600 |
| 2006/0113515 | A1 * | 6/2006 | Venegas, Jr. | 256/1 |
| 2011/0107635 | A1 * | 5/2011 | Walters | 40/612 |

* cited by examiner

*Primary Examiner* — Syed A Islam

(57) ABSTRACT

An advertising system for a bollard includes a bollard shield that can be installed over a conventional bollard. The bollard shield includes a shield inner diameter greater than the bollard outer diameter, forming a shield gap between the bollard and the bollard shield. One or more compressible foam pads are positioned in the shield gap between the bollard and the bollard shield. A resilient bollard sheath can be rolled onto the bollard shield. The bollard sheath includes advertising or graphical materials disposed thereon. The bollard sheath is generally replaceable without replacing the entire bollard shield. A removable sheath panel may be detachably secured on the bollard sheath to provide additional advertising or graphical material. The sheath panel may be interchangeably and replaced with additional sheath panels having different advertising information.

3 Claims, 4 Drawing Sheets

BOLLARD ADVERTISING SYSTEMS AND METHODS

CROSS-REFERENCES TO RELATED APPLICATIONS

This application claims benefit of the following patent application(s) which is hereby incorporated by reference: Provisional Patent Application, Ser. No. 61/352,222, filed Jun. 7, 2010, for an Advertising Sleeve For Bollards with Sheath and Tube.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND

The present invention relates generally to protective barriers for parking lots and roadways and more particularly to devices, systems and methods for covering protective barriers such bollards with advertising or other graphical materials.

A bollard is a post that is generally made of concrete, steel, or other similar material that is placed at strategic locations at or around commercial properties to protect the properties from vehicular traffic. For example, bollards are placed at the front entrance areas of stores so that vehicular traffic will not be able to collide with the building structure or invade into pedestrian walkways. Bollards are often placed at drive-through facilities at banks, restaurants and the like to keep vehicles from running onto curbs, hitting buildings, or otherwise creating collision damage to property or pedestrians. Bollards of this type are generally round posts projecting upward from the ground and may be either buried in the ground or otherwise stably installed to give more than minimal resistance to vehicle traffic.

Bollards often times get scraped and scratched and need to be repaired and/or repainted in order to avoid becoming an eyesore. Bollard covers are known in the art to include a shield for protecting a bollard. Conventional bollard shields may be formed of a rigid material such as a metal or a plastic. Conventional bollard covers, or bollard shields, come in various colors and may include a color integral with the material of the shield, for example a molded plastic product, and thus when the shield is scratched, the exterior color remains the same. Bollard shields generally are constructed of a size to fit over conventional metal or concrete bollards and are held in place by a close fit between the bollard and the bollard cover.

One problem associated with conventional bollard covers is a lack of advertising material positioned on the bollard cover. In many applications, it may be desirable for a property owner, lessee, operator or other entity to use a bollard surface as an advertising display. However, conventional bollard covers are not suitable for direct application of advertising materials. Such application of advertising materials or other graphical materials directly onto conventional bollards or conventional bollard covers would add significant cost and manufacturing complexity, as the materials would need to be printed or painted directly onto each bollard or bollard cover. Additionally, if the conventional bollard or conventional bollard cover with advertising material printed thereon were to become damaged, the entire bollard or bollard cover would need to be repainted, reprinted or replaced, thereby adding significant cost when the underlying functionality of the bollard or bollard cover may not be impaired. Further, conventional bollards and conventional bollard covers include a relatively small diameter that does not provide an outer surface with adequate area for applying advertising materials or other graphical materials such as text, signage or logos. Advertising materials or graphical materials applied to such conventional bollards or bollard covers would be difficult to view.

What is needed, then, are bollard advertising devices, systems and methods that allow graphical materials such as advertisements, logos, color patterns and the like to be installed onto conventional bollards and bollard covers.

BRIEF SUMMARY

The present invention generally includes devices, systems and methods for installing advertising or graphical materials onto a conventional bollard or bollard cover.

In some embodiments, the present invention includes an advertising system for positioning on a bollard, the bollard having a distal bollard end extending from a surface. The system includes a compressible pad configured to fold over the distal bollard end. A hollow bollard shield has a shield inner diameter dimensioned to receive the bollard and pad when the pad is folded over the distal bollard end. A bollard sheath is shaped to fit over the bollard shield. A removable sheath panel is configured to partially cover the bollard sheath.

In a further embodiment, the present disclosure provides a device for installation on a bollard shield, the bollard shield being shaped to cover a bollard. The device includes a bollard sheath having a closed distal sheath end and an open, rollable sheath base. A sheath panel is configured to engage the bollard sheath between the distal sheath end and the sheath base. The sheath panel is dimensioned to partially cover the bollard sheath.

In yet another embodiment, the present disclosure provides a bollard cover apparatus for positioning on a bollard. The bollard cover apparatus includes a bollard cover having a hollow interior and an open bollard cover base shaped for axial installation onto the bollard. The bollard includes an outer bollard diameter, and the bollard cover includes a bollard cover inner diameter, wherein the ratio of the bollard cover inner diameter to the bollard outer diameter is greater than about 1.2. In some embodiments, the bollard includes a free distal bollard end, and the bollard cover apparatus includes a compressible pad configured to fold over the free distal bollard end. The bollard cover is dimensioned to slide over the bollard when the compressible pad is folded over the free distal bollard end. The compressible pad may be compressed by the bollard cover when the bollard cover is slid onto the bollard, thereby providing a compression fit between the bollard cover and the bollard.

In an additional embodiment, the present disclosure provides an advertising system including a bollard having a distal bollard end projecting upward from a surface. A compressible pad is positioned against the bollard. A bollard shield is positioned over the bollard and pad. A bollard sheath is positioned over the bollard shield, and a removable sheath panel is detachably secured to the bollard sheath. The sheath panel partially covers the bollard sheath.

Numerous other objects, features and advantages of the present disclosure will be readily apparent to those skilled in the art upon a reading of the following description when taken in conjunction with the accompanying drawings.

DETAILED DESCRIPTION

The present invention generally provides devices, systems and methods for providing advertising or other graphical materials on a conventional bollard or conventional bollard cover. It will be readily appreciated by those of skill in the art that the present invention includes numerous embodiments and several novel individual components.

Figure 1:
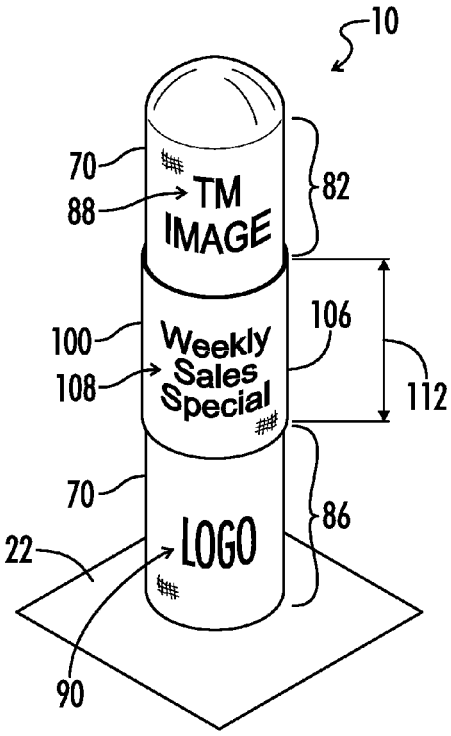
FIG. 1 illustrates a perspective view of an embodiment of an advertising system in accordance with the present disclosure.

Referring now to the drawings, FIG. 1 illustrates an embodiment of an advertising system 10 as it may be viewed from the exterior. Advertising system 10 as seen from the outside generally includes a bollard sheath 70 having a first visible sheath surface section 82 and a second visible sheath surface section 86. Each visible section of bollard sheath 70 may include advertising or graphical material such as text, color, logos or other types of markings. For example, first visible sheath surface section 82 includes a first graphical material 88. Second visible sheath surface section 86 includes a second graphical material 90. In some embodiments, first and second graphical materials 88, 90 include logos, images, trademarks, color patterns or other graphical works that may be associated with a store or business. The visible exterior surfaces may be viewed by customers or other individuals driving, walking or otherwise passing near the bollard with the advertising system 10 installed thereon.

Figure 2:
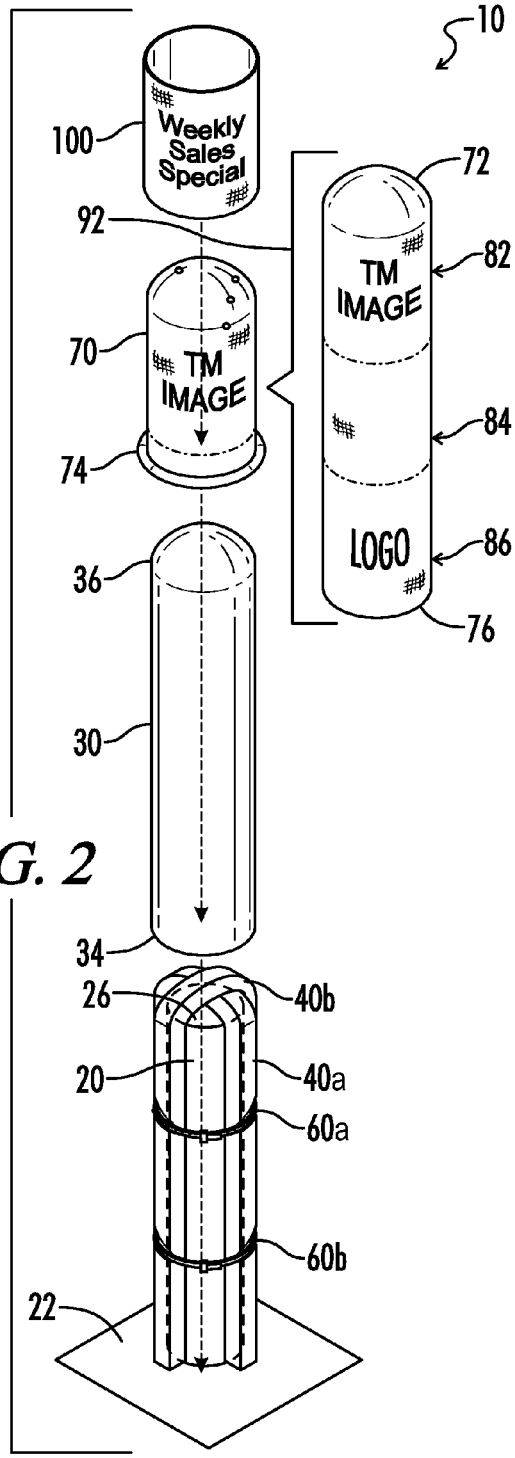
FIG. 2 illustrates an exploded perspective view of the embodiment of an advertising system of FIG. 1.

Also seen in FIG. 1, a removable sheath panel 100 is detachably secured to sheath 70. Removable sheath panel 100 has a visible sheath panel surface 106. A panel graphic 108 can be included on all or part of sheath panel surface 106. Panel graphic 108 can include advertising material or other types of graphical material such as logos, text, pricing specials, color patterns, etc. As seen in FIG. 1 and FIG. 2, sheath panel 100 includes a panel height 112. Bollard sheath 70 includes a sheath height 92. In some embodiments, panel height 112 is less than sheath height 92. In such embodiments, sheath panel 100 does not completely cover the exterior of bollard sheath 70 when installed on bollard shield 30. As such, one or more regions of bollard sheath 70 are visible when sheath panel 100 is installed.

Advertising system 10, as illustrated in the embodiment in FIG. 1, allows information to be provided to customers before they enter a store. The graphical materials included in advertising system 10 can provide information about store specials and can encourage customers to stop and enter a store that they might otherwise pass by without entering. Additionally, removable sheath panel 100 allows for customization of advertising information without removing sheath 70. Such usage is advantageous in many applications where sheath 70 may include general information such as a store name or store logo that does not need to be updated regularly. However, other advertising information may need to be changed on a daily, weekly, monthly, etc. basis. Removable sheath panel 100 allows such specific information to be quickly and easily changed without removing bollard sheath 70 from bollard shield 30.

Referring now to FIG. 2, an embodiment of an advertising system 10 is generally illustrated in an exploded view. As seen in FIG. 2, a conventional bollard 20 is secured to a ground surface 22. Ground surface 22 can include a parking lot, driveway, sidewalk or other suitable surface. Bollard 20 includes a distal bollard end 26 projecting away from ground surface 22. A bollard shield 30 can be positioned over bollard 20. Bollard shield 30 includes an open shield base 34 and a closed distal shield end 36. In some embodiments, distal shield end 36 may be fully or partially open. Bollard shield 30 includes a hollow interior shaped to receive bollard 20. Bollard shield 30 is generally axially slid onto bollard 20, as seen in FIG. 2. Bollard shield 30 in some embodiments can include any rigid or semi-rigid material, such as but not limited to a plastic, a composite or a metal.

A bollard sheath 70 is placed onto bollard shield 30. Bollard sheath 70 may be placed onto bollard shield 30 either before or after bollard shield 30 is installed on bollard 20. Bollard sheath 70 generally includes a resilient or elastic-like material that fits over the shield. Bollard sheath 70 can include a variety of materials such as but not limited to a woven-type fabric or a polymer material. Bollard sheath 70 may be provided in a rolled form similar to the form of a condom. As seen in FIG. 2, bollard sheath 70 includes a rolled sheath end 74. Rolled sheath end 74 generally includes an opening for receiving bollard shield 30. Bollard sheath 70 also includes a distal sheath end 72. Distal sheath end 72 is generally closed. Bollard sheath 70 may be positioned against the distal shield end 36 of bollard shield 30 and may be unrolled downward against bollard shield 30 toward shield base 34. As bollard sheath 70 is unrolled against bollard shield 30, bollard sheath 70 conforms to the shape of bollard shield 30, and sheath surface sections having advertising or graphical materials pre-disposed on bollard sheath 70 become visible.

Referring further to FIG. 1 and FIG. 2, a bollard sheath panel 100 can be positioned on bollard sheath 70. Bollard sheath panel 100 as illustrated in one embodiment in FIG. 2 includes a tube-shaped section that can be slid axially onto bollard sheath 70 from above. Bollard sheath panel 100 includes an inner panel diameter that is substantially the same as or slightly less than the outer diameter of bollard sheath 70 when bollard sheath 70 is positioned on bollard shield 30. As such, bollard sheath panel 100 engages bollard sheath 70 in friction fit in some embodiments. Bollard sheath panel 100 can include a resilient or elastic-type material that may stretch when slid onto bollard sheath 70. The elastic nature of bollard sheath panel 100 allows bollard sheath panel 100 to securely cling to bollard sheath 70 in a friction fit so as to prevent bollard sheath panel 100 from inadvertently sliding upward or downward.

The advertising system of the present invention contemplates the changing of advertising materials on a frequent basis. The present invention allows the full height of bollard shield 30 to include graphics via bollard sheath 70 along with bollard shield panel 100. Bollard shield panel 100 contains specific advertising graphics or text and can be changed out very frequently. This modular arrangement allows tremendous cost savings for changing advertising content on a regular, frequent and periodic basis. Conventional methods requiring changing the entire bollard sheath 70 is a more expensive undertaking than simply changing out the bollard shield panel 100 while leaving the bollard sheath 70 installed on bollard shield 30.

Figure 8:
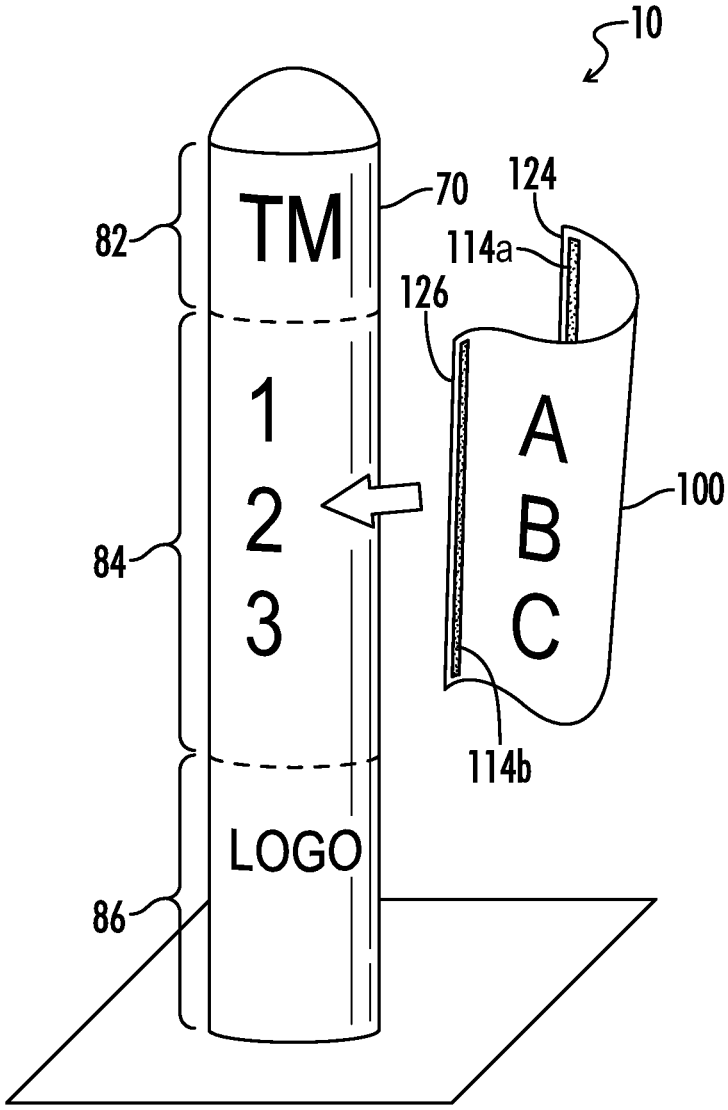
FIG. 8 illustrates an embodiment of an advertising system including a removable sheath panel configured for radial installation on a bollard, bollard shield or bollard sheath.

Referring now to FIG. 8, in some embodiments, it may be advantageous to provide a bollard sheath panel 100 that can be installed onto the bollard sheath 70 from a radial orientation, as opposed to the axial installation orientation seen in FIG. 2. As seen in FIG. 8, in some embodiments, bollard sheath panel 100 includes a first free edge 124 and a second free edge 126. A panel fastener 114 can be used to secure first and second free edges 124, 126 together after bollard sheath panel 100 is applied generally radially onto bollard sheath 70. In some embodiments, panel fastener 114 includes a first panel fastener 114*a* attached to first free end 124 and a second panel fastener 114*b* attached second free end 126. First and second panel fasteners 114*a*, 114*b* can include any suitable fastener for securing bollard sheath panel 100 onto bollard sheath 70 or bollard shield 30, including but not limited to hook and loop fabrics or a zipper. Sheath panel 100 is detachably securable to bollard sheath 70 by either axially sliding sheath panel 100 along bollard sheath 70 or by disengaging panel fastener 114 and removing sheath panel 100 from bollard sheath 70.

As seen in FIG. 8, bollard sheath 70 includes a first sheath surface section 82, a second sheath surface section 86 and a third sheath surface section 84 positioned between the first and second sheath surface sections 82, 86. Bollard sheath panel 100 can be applied to second sheath surface section 84. In some embodiments, second sheath surface section 84 is generally blank and is intended to be covered by bollard sheath panel 100. In other embodiments, second sheath surface section 84 includes an advertising material or graphical material disposed thereon. As such, second sheath surface section 84 provides advertising information even when bollard sheath panel 100 is removed. In such embodiments, the advertising material included on second sheath surface section 84 can be selectively covered using bollard sheath panel 100, which may include different advertising or graphical material, as seen in FIG. 8.

Figure 3:
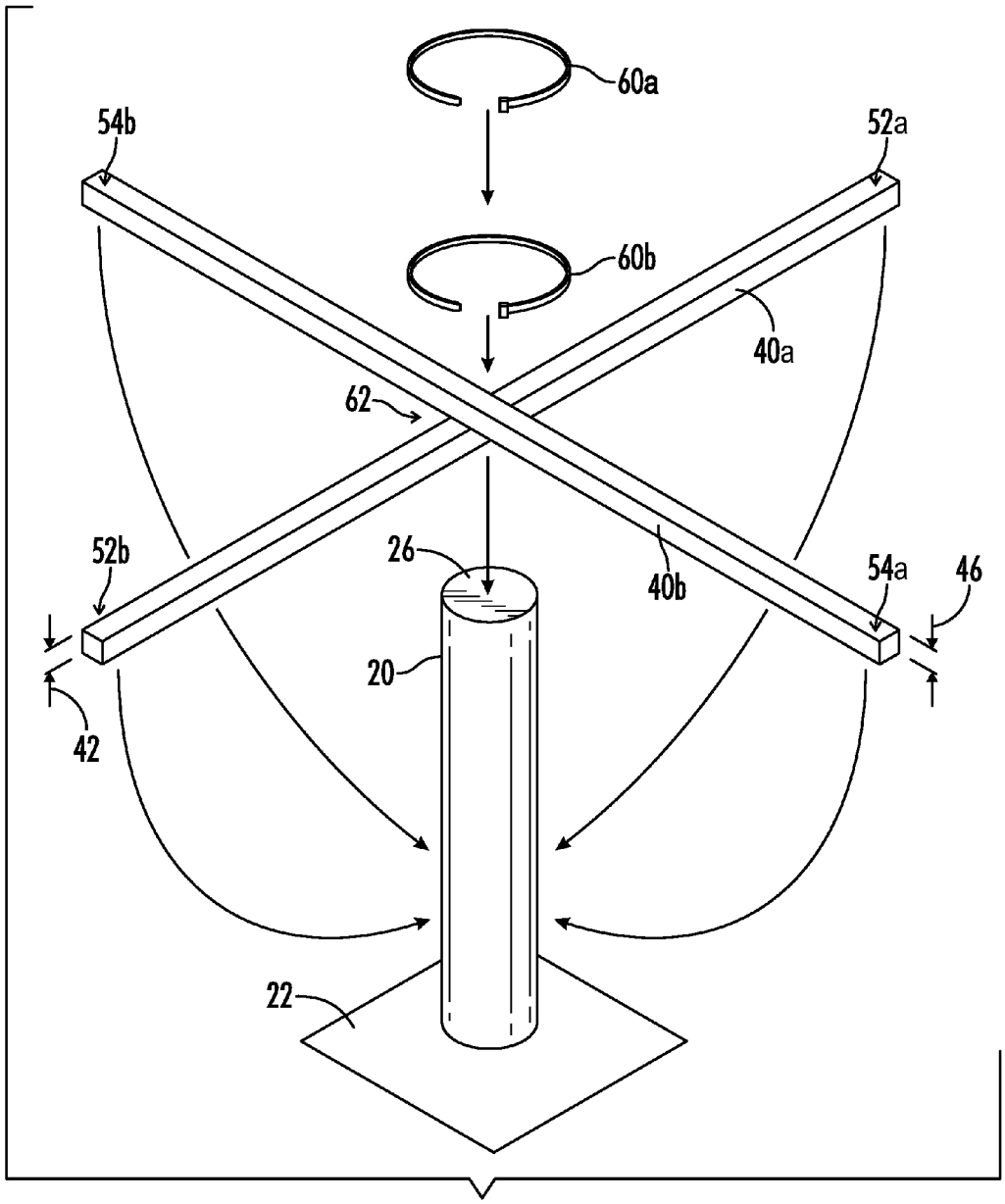
FIG. 3 illustrates a partially exploded perspective view of a bollard with first and second pads and first and second cables oriented for installation on the bollard.
Figure 4:
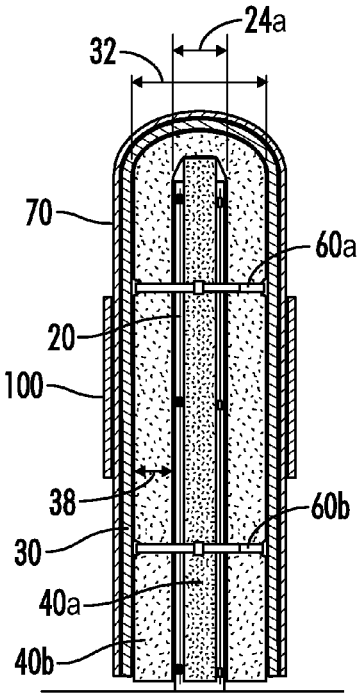
FIG. 4 illustrates a cross-sectional view of an embodiment of an advertising system in accordance with the present disclosure installed on a bollard having a first diameter.

Referring again to FIG. 2 and FIG. 3, in the present invention, the bollard shield 30 may be positioned over an existing bollard 20. In some embodiments, the bollard shield 30 generally includes a shield diameter greater than the outer diameter of the bollard 20. By providing a shield inner diameter greater than the bollard diameter, a larger surface area is provided for placing advertising materials or other graphical materials. However, such a configuration provides a bollard shield 30 having a shield inner diameter greater than the outer bollard diameter. As such, a shield gap 38, seen in FIG. 4, is created between the bollard 20 and the bollard shield 30. Thus, the bollard shield 30 of some embodiments of the present invention is distinguishable over conventional bollard shields because conventional bollard shields are generally dimensioned to provide a close fit between the bollard shield 30 and the bollard 20, i.e. conventional bollard shields do not provide a shield gap. In contrast to conventional bollard shields, some embodiments of the present invention intentionally provide a radial shield gap 38 between the bollard 20 and the bollard shield 30 when the bollard shield 30 is installed on the bollard 20. In some embodiments, the ratio of the shield inner diameter to bollard outer diameter is between about one and about ten. In further embodiments, the ratio of the shield inner diameter to the bollard outer diameter is between about 1.2 and about three.

In some embodiments, the present invention provides one or more compressible pads 40 positioned between the bollard shield 30 and the bollard 20. Each compressible pad is positioned to span the shield gap 38 and to fill the space between the bollard 20 and the bollard shield 30. As seen in FIG. 3, in some embodiments, a first compressible pad 40*a* may be positioned against distal bollard end 26. First compressible pad 40*a* is configured to be folded over the distal bollard end. For example, first compressible pad 40*a* includes a first pad end 52*a* and a second pad end 52*b*. First compressible pad 40*a* is positioned against distal bollard end 26 at an intermediate location between first and second pad ends 52*a*, 52*b*. First and second pad ends 52*a*, 52*b* may then be folded downward toward bollard 20 as indicated by the arrows in FIG. 3. As a result, first compressible pad 40*a* generally extends axially along the length of bollard 20, as seen in FIG. 4. This orientation of first compressible pad 40*a* facilitates axial installation of bollard shield 30 over bollard 20 and first compressible pad 40*a*. Similarly, a second compressible pad 40*b* may be positioned against first compressible pad 40*a* at a pad intersection location 62 near distal bollard end 26. Second compressible pad 40*b* is configured to be folded over first compressible pad 40*a* and distal bollard end 26. For example, second compressible pad 40*b* includes third and fourth pad ends 54*a*, 54*b* that are moved downward toward bollard 20 as indicated by the arrows in FIG. 3, resulting in the configurations seen in FIG. 2 and FIGS. 4-6. In other embodiments, each compressible pad is not configured to be folded over distal bollard end 26, but is simply applied against the surface of bollard 20.

After first compressible pad 40*a* and/or second compressible pad 40*b* are positioned against bollard 20, one or more cable ties 60 may be used to secure first and/or second compressible pads 40*a*, 40*b* in place against bollard 20. In some embodiments, a first cable tie 60*a* is positioned around first and second compressible pads 40*a*, 40*b* near distal bollard end 26, and a second cable tie 60*b* is positioned around first and second compressible pads 40*a*, 40*b* between first cable tie 60*a* and ground 22. Each cable tie 60 can include any suitable device for securing first and/or second compressible pads 40*a*, 40*b* in place, including but not limited to string, rope, wire, plastic zip-ties, etc. In other embodiments, other types of fastening devices may be used to secure each compressible pad to bollard 20. For example, in some embodiments, each pad 40 includes an adhesive backing for securement directly to bollard 20. In other embodiments, other suitable types of fastening devices may be used to secure each pad 40 to bollard 20. Additionally, each compressible pad 40 can include any suitable compressible material such as but not limited to open-cell or closed-cell foam material in some embodiments.

Figure 5:
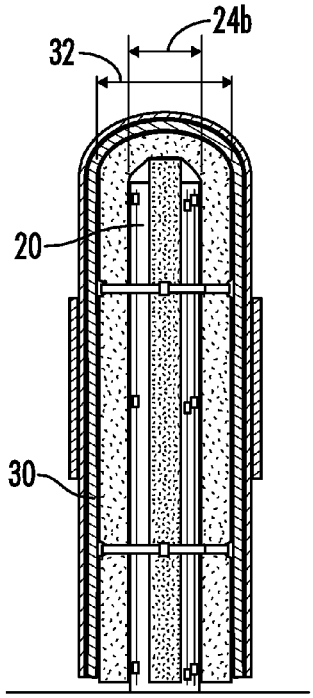
FIG. 5 illustrates a cross-sectional view of an embodiment of an advertising system in accordance with the present disclosure installed on a bollard having a second diameter greater than the first diameter of the bollard illustrated in FIG. 4.
Figure 6:
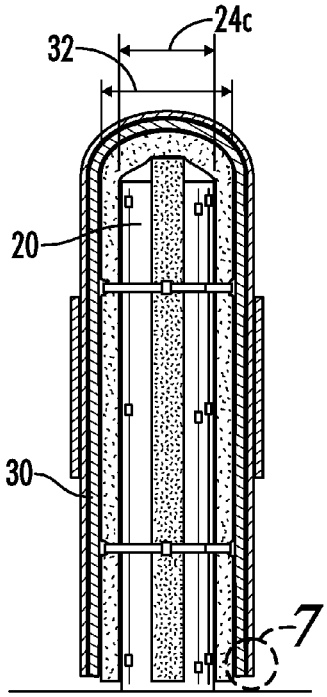
FIG. 6 illustrates a cross-sectional view of an embodiment of an advertising system in accordance with the present disclosure installed on a bollard having a third diameter greater than the first and second diameters of the bollards illustrated in FIG. 4 and FIG. 5.

Placement of one or more compressible pads 40 between bollard 20 and bollard shield 30 allows a large diameter bollard shield 30 to be used interchangeably with different-sized bollards 20. For example, as seen in FIG. 4, a bollard 20 having a first bollard diameter 24*a* includes first and second pads 40*a*, 40*b* disposed thereon. A bollard shield 30 having a shield inner diameter 32 is positioned over bollard 20 and first and second pads 40*a*, 40*b*. Because first and second pads 40*a*, 40*b* are resilient and compressible, bollard shield 30 can be easily slid over bollard 20. Referring to FIG. 5, a bollard shield 30 having the same shield inner diameter 32 is positioned over a second bollard 20 having a second bollard diameter 24*b*. Second bollard diameter 24*b* is larger than first bollard diameter 24*a*, yet the same size bollard shield 30 can be used to accommodate second bollard diameter 24*b* because first and second pads 40*a*, 40*b* may be compressed to fill the space between second bollard 20 and bollard shield 30. Similarly, referring to FIG. 6, bollard shield 30 may be interchangeably positioned over a third bollard 20 having a third bollard diameter 24*c* greater than first and second bollard diameters 24*a*, 24*b*.

Once the bollard shield 30 of the present invention is placed over the bollard 20 and held in place by pads 40*a*, 40*b*, if a vehicle rubs against or crashes into the shield covered bollard 20, the bollard shield 30 will move slightly with the compression of the foam and thus be less likely to get damaged. Because most of these applications are in areas where there is slow traffic and the impact on the shield covered bollard is very small, when a driver of a vehicle sees the bollard shield 30 move, they will stop and back up to avoid making any serious damage to the bollard itself or to the vehicle. The elastic nature of the foam that holds the shield in place will then regenerate so the shield is fitted uniformly about the bollard. Thus, by providing a bollard and bollard shield having a pad-filled shield gap therebetween, the present invention provides a barrier that prevents damage both to the bollard and to an automobile during a collision.

Figure 7:
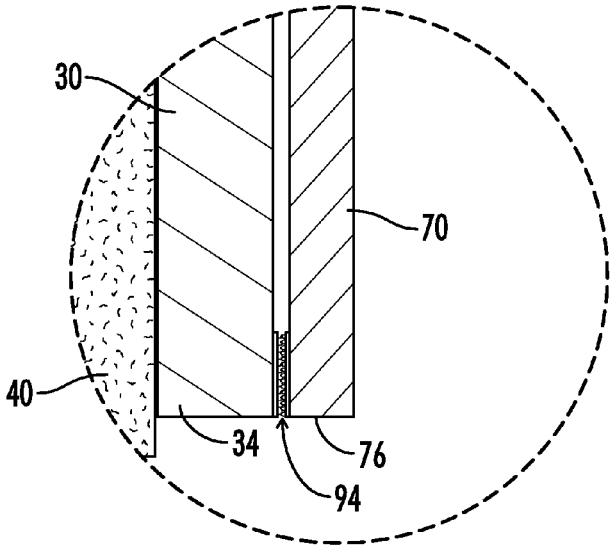
FIG. 7 illustrates a detail partial cross-sectional view of Section 7 from FIG. 6 showing a sheath base attachment configuration in accordance with the present disclosure.

When bollard sheath 70 is positioned over bollard shield 30 in some applications, it is generally desirable to provide a fastener to prevent bollard sheath 70 from inadvertently separating from bollard shield 30. As seen in FIG. 7, in some embodiments, a sheath fastener 94 may be positioned between shield base 34 and sheath base 76. Sheath fastener 94 can include any suitable fastener, including but not limited to a mechanical fastener such one or more hook and loop fabrics, buttons, snaps, magnets, etc. In some embodiments, sheath fastener 94 may include an adhesive. In additional embodiments, shield panel 100 may be secured to bollard sheath 70 using mechanical fasteners such as snaps, hook and loop fabric, buttons or other suitable fasteners.

In additional embodiments, the present invention provides a method of retrofitting a conventional bollard to include advertising material. The method includes the steps of (a) providing a bollard having a bollard outer diameter and a bollard shield having a shield inner diameter greater than the bollard outer diameter; (b) applying a compressible foam pad against the bollard; (c) axially sliding the bollard shield onto the bollard and pad; (d) rolling a bollard sheath onto the bollard shield; and (e) attaching a first sheath panel to the bollard sheath such that the first sheath panel only partially covers the bollard sheath. The method can include the additional step of removing the first sheath panel and attaching a second sheath panel to the bollard sheath.

Thus, although there have been described particular embodiments of the present invention of new and useful Bollard Advertising Systems and Methods, it is not intended that such references be construed as limitations upon the scope of this invention except as set forth in the following claims.

I claim:

1. An advertising system for positioning on a bollard comprising a bollard, the bollard having a distal bollard end extending from a surface, a rectangular cube shaped compressible pad folding over the distal bollard end in a first direction; a second rectangular cube shaped compressible pad folding over the first rectangular cube shaped compressible pad and the distal bollard end in a second direction, wherein the first direction is perpendicular to the second direction; a rigid hollow bollard shield in the shape of test-tube, having a shield inner diameter dimensioned to receive the bollard and compressible pads, when the pads are folded over the distal bollard end, a flexible bollard sheath in the shape of a test-tube, shaped to fit over the bollard shield; and a tubular shaped removable sheath panel configured to partially cover the flexible bollard sheath, further comprising the rigid bollard shield including a shield base; the flexible bollard sheath including a sheath base; and a sheath fastener disposed between the shield base and a sheath base.

2. The system of claim 1, further comprising; the bollard removable sheath shaped to fit the bollard sheath including a sheath surface and a first graphical material disposed on the first exposed surface section.

3. The system of claim 2, further comprising: a graphical material includes a second removable sheath panel the partially cover the first graphical material.

* * * * *